US009476686B2

(12) United States Patent
Greeley et al.

(10) Patent No.: US 9,476,686 B2
(45) Date of Patent: Oct. 25, 2016

(54) DEVICE FOR TRANSFERRING ENERGY OUTPUT FROM ONE PYROTECHNIC DEVICE TO ANOTHER

(71) Applicant: Fike Corporation, Blue Springs, MO (US)

(72) Inventors: William Greeley, Lafayette, NJ (US); Raivo Kull, West Caldwell, NJ (US); Ed Soohoo, Stanhope, NJ (US)

(73) Assignee: Fike Corporation, Blue Springs, MO (US)

( * ) Notice: Subject to any disclaimer, the term of this patent is extended or adjusted under 35 U.S.C. 154(b) by 0 days.

(21) Appl. No.: 14/609,151

(22) Filed: Jan. 29, 2015

(65) Prior Publication Data

US 2015/0144399 A1 May 28, 2015

Related U.S. Application Data

(62) Division of application No. 13/833,723, filed on Mar. 15, 2013, now Pat. No. 8,943,970.

(60) Provisional application No. 61/637,541, filed on Apr. 24, 2012.

(51) Int. Cl.
*F42C 15/29* (2006.01)
*F42D 1/04* (2006.01)
(Continued)

(52) U.S. Cl.
CPC ..... *F42D 1/043* (2013.01); *E21B 7/007* (2013.01); *F42C 19/0807* (2013.01); *F42C 19/0815* (2013.01)

(58) Field of Classification Search
CPC ..... F42C 11/02; F42C 15/29; F42B 3/122; F42B 3/16
USPC ..... 102/275.1–275.8, 202, 205, 320, 318, 102/322; 175/2
See application file for complete search history.

(56) References Cited

U.S. PATENT DOCUMENTS 2,561,670 A * 7/1951 Miller ..... F02K 9/95 102/202
2,934,014 A * 4/1960 Smith ..... F02K 9/95 102/202
3,209,692 A * 10/1965 Webb ..... F42D 1/04 102/275.4

(Continued)

FOREIGN PATENT DOCUMENTS

WO 2011112647 9/2011

OTHER PUBLICATIONS

The International Search Report and Written Opinion dated Jan. 15, 2014, in PCT/US2013/032243 application filed Mar. 15, 2013.

*Primary Examiner* — Michael David
(74) *Attorney, Agent, or Firm* — Hovey Williams LLP

(57) ABSTRACT

An energy transfer device (10) is provided that is capable of transferring the energy output from one pyrotechnic device (52) to another device (78) for initiating firing thereof. Device (10) comprises a device housing (12) in which a deformable device insert (14) is received. Device insert (14) comprises a central passageway (34) for transmitting the output from a pyrotechnic device (52), including energy, gasses, and/or solids, to another pyrotechnic device (78). The passageway (34) conducts the pyrotechnic device output to a precise location on the second pyrotechnic device (78) where firing is most effectively initiated. The energy transfer device (10) may be employed as a part of a tool (44) used in well completion operations.

17 Claims, 2 Drawing Sheets

(51) Int. Cl.
*E21B 7/00* (2006.01)
*F42C 19/08* (2006.01)

(56) References Cited

U.S. PATENT DOCUMENTS

| | | | | | |
|---|---|---|---|---|---|
| 3,578,011 | A | | 5/1971 | Holmes | |
| 3,945,322 | A | * | 3/1976 | Carlson | F42D 1/04 102/275.4 |
| 3,982,488 | A | * | 9/1976 | Rakowsky | F02K 9/95 102/205 |
| 4,033,267 | A | | 7/1977 | Morris et al. | |
| 4,060,033 | A | | 11/1977 | Postupack et al. | |
| 4,060,034 | A | | 11/1977 | Bowman et al. | |
| 4,135,454 | A | | 1/1979 | Morris et al. | |
| 4,165,691 | A | | 8/1979 | Bowman et al. | |
| 4,178,852 | A | | 12/1979 | Smith et al. | |
| 4,653,400 | A | * | 3/1987 | Crawford | F42C 19/0819 102/202 |
| 4,660,473 | A | | 4/1987 | Bender et al. | |
| 4,765,246 | A | | 8/1988 | Carlsson et al. | |
| 4,856,433 | A | | 8/1989 | Evans | |
| 4,938,141 | A | * | 7/1990 | Gallant | F42D 1/04 102/275.11 |
| 5,377,592 | A | | 1/1995 | Rode et al. | |
| 5,435,248 | A | | 7/1995 | Rode et al. | |
| 5,614,693 | A | * | 3/1997 | Welch | C06C 5/06 102/275.4 |
| 5,780,764 | A | | 7/1998 | Welch et al. | |
| 5,959,236 | A | * | 9/1999 | Smith | F42C 19/0815 102/200 |
| 6,615,736 | B2 | | 9/2003 | Duparc et al. | |
| 7,073,448 | B2 | | 7/2006 | Bell | |
| 7,987,787 | B1 | * | 8/2011 | Sudick | F42B 3/18 102/202.1 |
| 8,561,683 | B2 | | 10/2013 | Wood et al. | |
| 8,622,149 | B2 | | 1/2014 | Gill et al. | |
| 2010/0000789 | A1 | | 1/2010 | Barton et al. | |
| 2012/0055365 | A1 | | 3/2012 | Ritchie | |
| 2013/0277108 | A1 | * | 10/2013 | Greeley | F42D 1/043 175/2 |

* cited by examiner

DEVICE FOR TRANSFERRING ENERGY OUTPUT FROM ONE PYROTECHNIC DEVICE TO ANOTHER

RELATED APPLICATION

The present application is a divisional of U.S. application Ser. No. 13/833,723 filed Mar. 15, 2013, entitled ENERGY TRANSFER DEVICE, which claims the benefit of U.S. Provisional Patent Application No. 61/637,541, filed Apr. 24, 2012. Both applications are incorporated by reference herein in their entireties.

BACKGROUND OF THE INVENTION

1. Field of the Invention

The present invention is directed toward an energy transfer device that is configured to transmit energy released from the output of a first pyrotechnic device to a second pyrotechnic device in order to initiate firing of the second pyrotechnic device. The energy transfer device absorbs energy released by the output charge of the first pyrotechnic device, such as a time delay fuse, and directs at least a portion of the energy toward the second pyrotechnic device in a controlled manner so as to efficiently and reliably facilitate firing of the second pyrotechnic device.

2. Description of the Prior Art

Pyrotechnic devices are commonly employed to ignite or detonate explosive charges in a variety of industrial applications such as oil well completion operations. Time delay fuses are exemplary pyrotechnic devices that can be used to initiate detonation of the explosive material used in the blasting operation. Time delay fuses are generally available in predetermined delay time increments. However, in certain applications, longer time delays are desired beyond what a single time delay fuse is configured to supply. In such instances, blasting operators may stack a plurality of fuses in series with the expectation that the output charge from one fuse will ignite the primer or ignition charge of the next fuse.

Time delay fuses generally are not designed or configured for use in this manner. Thus, in certain circumstances, the output charge from the time delay fuse can fail to ignite the adjacent fuse, thereby resulting in failure to detonate the primary explosive used in the blasting operation. In the context of downhole operations, failure to detonate the primary explosive may require that the tool including the primary explosive be run back up the hole and a new string of time delay fuses be installed. Pulling pipe string is an expensive and time-consuming operation. The presence of explosive devices further complicates this operation due to their inherently dangerous nature.

Therefore, there exists a need in the art for reliably effecting transfer of the output energy from one time delay fuse to another ensuring that the subsequent fuse in the chain ignites.

SUMMARY OF THE INVENTION

The present invention provides a solution to this problem by providing an energy transfer device configured to transfer the energy output from a first pyrotechnic device to a second pyrotechnic device for initiating firing of the second pyrotechnic device. In one embodiment, the energy transfer device comprises a metallic body having a forward section configured to be placed adjacent the first pyrotechnic device and an aft section configured to be placed adjacent the second pyrotechnic device. The metallic body further includes an axial passageway extending therethrough. The passageway includes a first segment extending through the body forward section and a second segment extending through the body aft section. The body forward section is deformable by the energy output from the first pyrotechnic device such that the diameter of the passageway first segment is narrowed thereby forming a constriction in the passageway.

According to another embodiment of the present invention, there is provided an energy transfer device configured to transfer the energy output from a first pyrotechnic device to a second pyrotechnic device for initiating firing of the second pyrotechnic device. The energy transfer device comprises a device housing including a central bore extending therethrough, and a device insert carried by the housing within the bore. The housing includes a housing forward section and a housing aft section. The insert comprises an insert forward section and an insert aft section and an axial passageway extending therethrough. The housing forward section and the insert forward section are configured for placement adjacent the first pyrotechnic device, and the housing aft section and the insert aft section are configured for placement adjacent the second pyrotechnic device. The insert forward section is deformable by the energy output from the first pyrotechnic device such that a constriction is formed in the passageway.

According to yet another embodiment of the present invention, there is provided a tool for delivering a pyrotechnic charge downhole in a well. The tool comprises a time delay fuse and an energy transfer device. The energy transfer device comprises a device housing including a central bore extending therethrough, and a device insert including an axial passageway extending therethrough. The device housing includes a housing forward section and a housing aft section. Likewise, the device insert also includes an insert forward section and an insert aft section. The device insert is configured to be positioned within the housing bore. The insert forward section is deformable by the energy output from a first pyrotechnic device such that a constriction is formed in the passageway.

In still another embodiment according to the present invention, there is provided a method of igniting a pyrotechnic charge downhole in a well. A first pyrotechnic device, an energy transfer device, and a second pyrotechnic device are provided. The energy transfer device comprises a metallic body having a forward section, an aft section, and an axial passageway extending therethrough. The first pyrotechnic device is ignited to detonate an output charge. At least a portion of the energy from the output charge is directed through the axial passageway toward the second pyrotechnic device thereby igniting the second pyrotechnic device.

DETAILED DESCRIPTION OF THE PREFERRED EMBODIMENT

Figure 2:
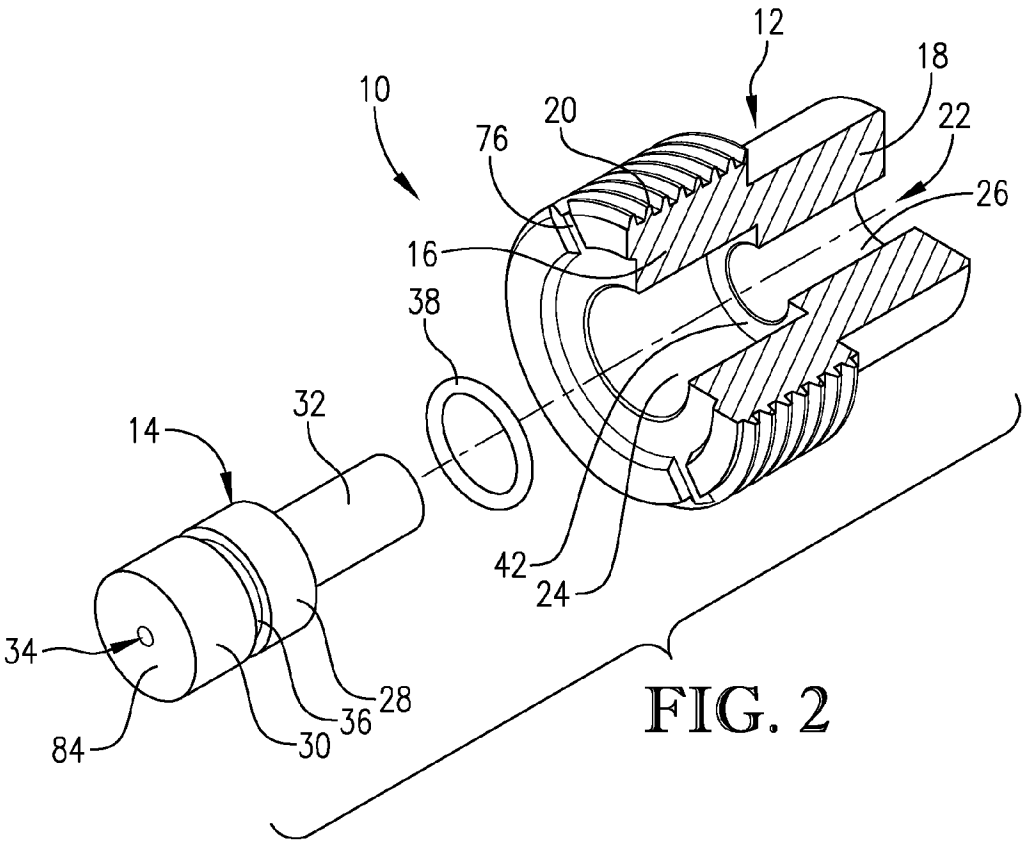
FIG. 2 is an exploded, perspective view of the energy transfer device of FIG. 1 illustrating the two-part construction thereof.
Figure 1:
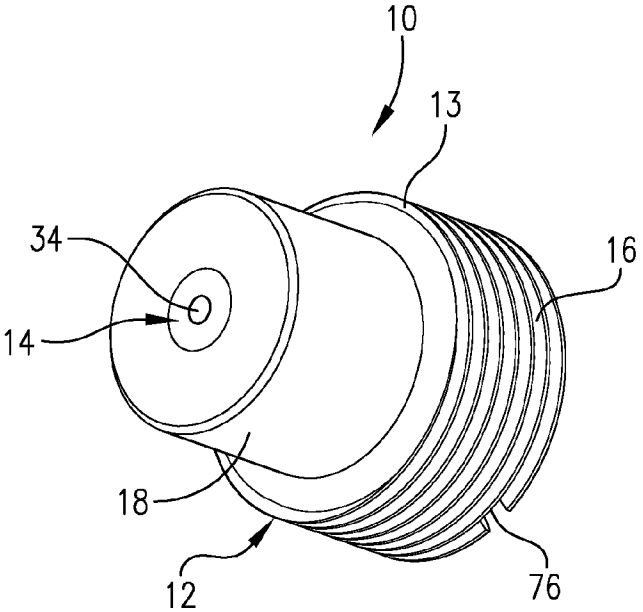
FIG. 1 is a perspective view of an energy transfer device according to one embodiment of the present invention.

Turning now to the Figures, and in particular FIGS. 1 and 2, an energy transfer device 10 according to one embodiment of the present invention is shown. Device 10 is a dynamic device that is configured to limit and convert a detonating output of a time delay fuse or similar device so that the output is suitable to ignite another time delay fuse or similar device without damaging the input and resulting in a failure to ignite. Device 10 is of two-piece construction comprising a device housing 12 and a device insert 14. Housing 12 comprises a metallic body 13 that includes a generally cylindrical forward section 16 configured to be placed adjacent to and facing the pyrotechnic device that is supplying the energy to be transferred to another pyrotechnic device and a generally cylindrical aft section 18 configured to be placed adjacent to and facing the pyrotechnic device receiving the transferred energy. In certain embodiments, forward section 16 may have a larger outer diameter than aft section 18. The outer surface of forward section 16 comprises threads 20 that permit housing 12 to be secured within a tool, such as might be used in downhole blasting operations. Body 13 comprises an axial bore 22 extending therethrough that is sized to receive device insert 14. Bore 22 includes a forward segment 24 and an aft segment 26, with said forward segment 24 generally having a greater diameter than aft segment 26, although this need not always be the case.

Figure 4:
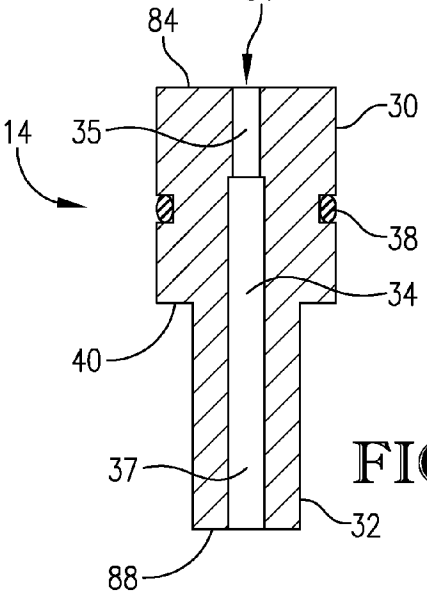
FIG. 4 is a cross-sectional view of the energy transfer device insert in its pre-firing configuration.

Device insert 14 comprises a metallic member 28 including a forward section 30 and an aft section 32. Forward section 30 is configured to be received within forward segment 24 of bore 22, and aft section 32 is configured to be received within aft segment 24 of bore 22. As best shown in FIG. 4, insert 14 further comprises a central, axial passageway 34 extending therethrough comprising respective forward and aft segments 35, 37. In certain embodiments, forward segment 35 may present a length that is less than the length of segment 37. Moreover, the diameter of segment 35 is less than the diameter of segment 37.

As discussed in greater detail below, passageway 34 operates as a conduit directing the output energy from one pyrotechnic device located adjacent forward sections 16 and 30 toward the second pyrotechnic device located adjacent aft sections 18 and 32. The forward section 30 of device insert 14 comprises a circumscribing channel 36 that is configured to receive an O-ring 38. O-ring 38 provides a seal between insert 14 and housing 12, and also assists in maintaining insert 14 within bore 22 upon assembly of device 10.

Forward section 30 of insert 14 generally is of greater diameter than aft section 32, thus corresponding with the general configuration of bore 22. The junction between forward section 30 and aft section 32 comprises a shoulder 40 that abuts a similarly configured shoulder 42 defining the junction between forward section 16 and aft section 18 of housing 12. The contacting engagement of both shoulders 40, 42 ensures proper mating of insert 14 and housing 12.

In certain embodiments, housing 12 and insert 14 can be manufactured from a variety of metals, including stainless steel, although different stainless steel alloys may be selected individually for each piece. In one particular embodiment, housing 12 may comprise 17-4 (AMS 5643) stainless steel, whereas insert 14 may comprise 304 or 304L stainless steel. In preferred embodiments, insert 14 comprises a metal having hardness and tensile strength values lower than the metal from which housing 12 is formed. As explained in greater detail below, manufacturing housing 12 and insert 14 from different materials permits insert 14 to undergo deformation upon firing of the first pyrotechnic device, while housing 12 resists deformation thereby permitting its reuse. It is notable, too, that device 10 does not itself comprise any pyrotechnic material.

While the embodiments of device 10 illustrated and described herein are of two-piece construction, it is within the scope of the present invention for device 10 to be of single-piece construction comprising a unitary body and a central, axial passageway. Such a single-piece device would retain the external configuration of housing 12 and the internal configuration of insert 14, namely passageway 34, described above.

Figure 3:
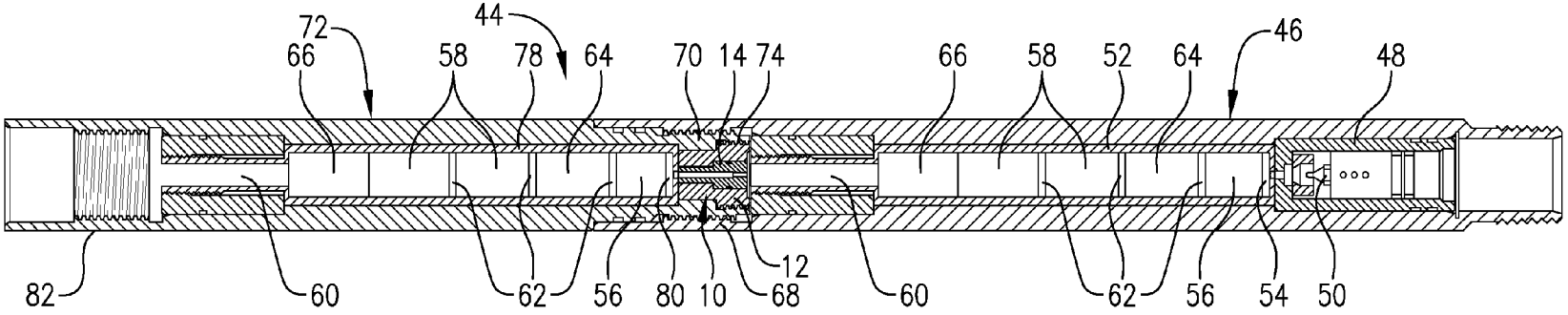
FIG. 3 is a schematic view of the energy transfer device utilized in a downhole tool in conjunction with time delay fuses.

As shown in FIG. 3, energy transfer device 10 can be installed within a tool 44, such as a firing head, for use in downhole blasting operations. Accordingly, tool 44 may be configured for attachment to a downhole pipe string or other downhole tool. Tool 44 generally comprises a firing section 46 that includes a firing head 48 equipped with a firing pin 50. Firing section 46 further comprises a first time delay fuse 52 disposed within a bore 54 formed in the firing section. Fuse 52 generally comprises a primer 56, one or more time delays 58, and an output charge 60. In certain embodiments, output charge 60 may comprise 2,2',4,4',6,6'-hexanitrostilbene (HNS-II). Other components that may be present within fuse 52 include one or more sections of ignition composition 62, an ignition charge 64, and a transfer charge 66. Firing section 46 also includes an internally threaded end region 68 configured for attachment to an externally threaded region 70 of a tool transfer section 72.

Energy transfer device 10 is received in region 70. Threads 20 of device 10 are configured to mate with corresponding threads 74 of region 70 to secure device 10 therein. Device housing 12 may further include a pair of slots 76 formed in the face of forward section 16 that are configured to receive a tool used in the installation of device 10 within section 70. A second time delay fuse 78 is received within a bore 80 formed in transfer section 72 and positioned adjacent the aft section 18 of device housing 12. Fuse 78 may be constructed identically to fuse 52, or it may be configured differently, such as possessing greater or fewer time delays 58. At the end opposite from energy transfer device 10, transfer section 72 comprises an internally threaded end region 82 that is similar in configuration to end region 68. End region 82 is configured for attachment to an additional transfer section 72 if further overall time delay is required. Alternatively, another type of pyrotechnic charge may be coupled with end region 82, such as the working explosive for the blasting operation.

Figure 5:
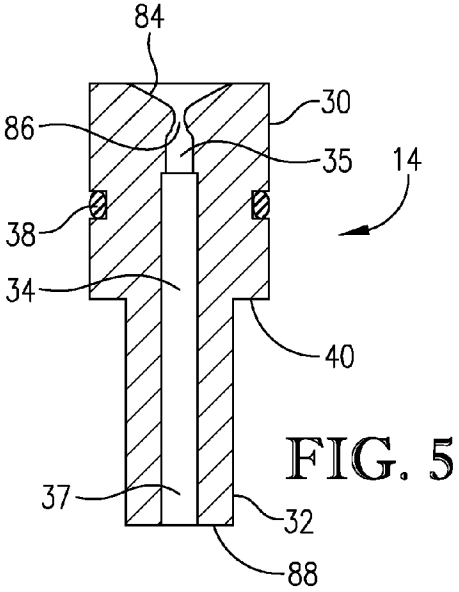
FIG. 5 is a cross-sectional view of the energy transfer device insert post-firing showing deformation of the insert and the formation of a passageway constriction.

During operation of tool 44, firing head 48 is actuated according to any means known to those of skill in the art and results in driving firing pin 50 toward time delay fuse 52. Firing pin 50 strikes primer 56 thereby igniting fuse 52. Combustion of the pyrotechnic material of which fuse 52 is comprised continues through output charge 60. The detonation of output charge 60 releases heat, gas, and/or solid particulates that are directed toward the energy transfer device, and specifically the respective faces of forward sections 16 and 30. The hot gasses generated by output charge 60 are directed through passageway forward segment 35 and exit device 10 via passageway aft segment 37. As noted above, device insert 14 may be constructed from material that is subject to deformation by the heat and gasses released by output charge 60, whereas housing 12 may be constructed from a material that is more resistant to being deformed by the output of fuse 52. Accordingly, upon detonation of output charge 60 the energy, hot gas and/or solids directed toward insert 14 cause the insert forward section 30 to deform. This deformation is shown in FIG. 5.

Particularly, the face 84 of forward section 30, which is initially planar, deforms thereby narrowing the diameter of passageway forward segment 35 and creating a constriction 86 therein. In one exemplary embodiment, passageway forward segment 35 has an initial diameter of 0.094 inch. A typical ambient temperature time delay fuse detonating output deforms the insert material to decrease the passageway forward segment diameter to between about 0.040-0.050 inch. The output of a time delay fuse at elevated temperature produces a 25% deeper dent in a steel test dent block and also decreases the insert port diameter to 0.030-0.039 inch. The decrease in passageway open area with a time delay fuse output is between 3.5 to 9.8 times depending on the strength of the detonation. When in use and acted on by the donor detonating device (e.g., fuse 52), deformation/denting of insert 14 absorbs a portion of the detonation energy. The geometry and material characteristics of insert 14 cause partial closing of the passageway forward segment 35 when used in close proximity to a detonating output that is capable of denting steel. It has been discovered that strong detonations cause more deformation thereby closing the passageway forward segment 35 to a smaller diameter and further limiting the detonation impact while still allowing sufficient ignition gasses and particles to pass through. Hence this action is self-regulating pending the power output level of the donor detonating device.

The constriction 86 in passageway forward segment 35 allows pressure from output charge 60 (e.g., a combination of the detonation pressure and heat from the HNS-II, the azide output energy and the output initiator energy, hot metal fragments, molten metal and slag) to be released over a longer time. Deformation from the HNS-II creates a conical impression, which is often covered with a slag after the deformation of face 84. Detonation of HNS-II usually only leaves black soot, thus, in certain embodiments, the observed slag on and in insert 14 indicates a flow of gasses and solids though the passageway 34 after the initial impact from detonation.

The two-part construction of device 10 permits housing 12 to be reused by simply replacing insert 14. Passageway aft segment 37 can have a larger initial diameter than passageway forward segment 35. The larger-diameter segment 37 functions as a renewable passage to ensure tool wear does not affect performance and to ensure the diameter and concentricity are controlled. It is noted that the area nearest to the input of the next delay usually expands also and would be a wear point if it were part of the re-useable tooling.

The energy, gas and/or solid products generated by combustion of output charge 60 are then carried through passageway 34 toward fuse 78. Upon reacting aft face 88 of insert 14, the hot gas and/or solids are focused directly on the primer 56 of fuse 78 and ensure ignition thereof. Thus, device 10 effectively and reliably transfers the output of fuse 52 to fuse 78 and ensures that the firing sequence, which began with firing head 48, continues. The output charge 60 of fuse 78 may then be transferred to another fuse through attachment of another transfer section 72 to end region 82, or to another type of pyrotechnic device such as another firing head or an explosive charge that might be used in the blasting operation.

We claim:

1. An energy transfer device configured to transfer the energy output from a first pyrotechnic device to a second pyrotechnic device for initiating firing of the second pyrotechnic device, said energy transfer device comprising:

a device housing including a central bore extending therethrough, said housing including a housing forward section and a housing aft section; and a device insert carried by said housing within said bore, said insert comprising an insert forward section and an insert aft section and an axial passageway extending therethrough, said housing forward section and said insert forward section being configured for placement adjacent to and facing the first pyrotechnic device, and said housing aft section and said insert aft section being configured for placement adjacent to and facing the second pyrotechnic device, said insert forward section being deformable by the energy output from the first pyrotechnic device such that a constriction is formed in said passageway.

2. The energy transfer device according to claim 1, wherein said housing forward and aft sections are substantially cylindrical, said housing forward section having a larger diameter than said housing of section.

3. The energy transfer device according to claim 1, wherein said housing forward section comprises a threaded outer surface.

4. The energy transfer device according to claim 1, wherein said insert forward and aft sections are substantially cylindrical, said insert forward section having a larger outside diameter than said insert of section.

5. The energy transfer device according to claim 1, wherein said passageway comprises a first segment that extends through said insert forward section, and a second segment that extends through said insert aft section, said first segment having an inside diameter, prior to deformation, that is less than the inside diameter of said passageway second segment.

6. The energy transfer device according to claim 5, wherein said passageway first segment has a length that is less than the length of said passageway aft section.

7. The energy transfer device according to claim 1, wherein said device does not comprise any pyrotechnic material.

8. The energy transfer device according to claim 1, wherein said insert forward section comprises a forward face configured to be placed adjacent the first pyrotechnic device so as to receive the output from the first pyrotechnic device, said forward face being deformable by the energy output from the first pyrotechnic device to form said constriction.

9. The energy transfer device according to claim 8, wherein said forward face is substantially planar prior to deformation.

10. The energy transfer device according to claim 8, wherein said passageway conducts the passage of gasses and/or solids generated by the first pyrotechnic device through said energy transfer device.

11. A tool for delivering a pyrotechnic charge downhole in a well comprising:

a time delay fuse; and the energy transfer device according to claim 1.

12. The tool according to claim 11, wherein said time delay fuse is positioned adjacent said device housing aft section.

13. The tool according to claim 12, wherein said tool is a firing head operable to ignite a pyrotechnic charge.

14. The tool according to claim 11, wherein said time delay fuse functions as the first pyrotechnic device and is responsible for the deformation of said insert forward section.

15. The tool according to claim 11, wherein said time delay fuse is positioned adjacent said device housing forward section.

16. The tool according to claim 15, wherein said tool comprises a second time delay fuse positioned adjacent said device housing aft section.

17. The tool according to claim 11, wherein said tool is configured to be coupled with a pipe string or other downhole tool.

* * * * *